United States Patent [19]

Gessinger et al.

[11] Patent Number: 4,479,833

[45] Date of Patent: Oct. 30, 1984

[54] PROCESS FOR MANUFACTURING A SEMI-FINISHED PRODUCT OR A FINISHED COMPONENT FROM A METALLIC MATERIAL BY HOT WORKING

[75] Inventors: Gernot Gessinger; Günther Schröder, both of Birmenstorf, Switzerland

[73] Assignee: BBC Brown, Boveri & Company, Limited, Baden, Switzerland

[21] Appl. No.: 466,339

[22] PCT Filed: Jun. 22, 1982

[86] PCT No.: PCT/CH82/00082

§ 371 Date: Feb. 2, 1983

§ 102(e) Date: Feb. 2, 1983

[87] PCT Pub. No.: WO83/00168

PCT Pub. Date: Jan. 20, 1983

[30] Foreign Application Priority Data

Jun. 26, 1981 [CH] Switzerland ..... 4244/81

[51] Int. Cl.[3] ..... C22D 1/04; C22D 1/08; C22D 1/10; C21D 7/14

[52] U.S. Cl. ..... 148/11.5 R; 148/11.5 A; 148/11.5 C; 148/11.5 N; 148/12 R; 148/12 E; 148/12 EA

[58] Field of Search ..... 148/11.5 R, 11.5 P, 148/11.5 N, 11.5 A, 11.5 C, 12 R, 12 E, 12 EA

[56] References Cited

U.S. PATENT DOCUMENTS

| | | | |
|---|---|---|---|
| 3,655,458 | 4/1972 | Reichman | 148/11.5 P |
| 4,081,295 | 3/1978 | Vogel | 148/11.5 P |
| 4,110,131 | 8/1978 | Gessinger | 148/11.5 N |
| 4,404,025 | 9/1983 | Mercier et al. | 148/11.5 N |

*Primary Examiner*—W. Stallard

*Attorney, Agent, or Firm*—Oblon, Fisher, Spivak, McClelland & Maier

[57] ABSTRACT

Semi-finished products and finished components are manufactured, by hot working, from alloys of aluminum, copper, nickel and iron, with and without oxidic dispersoids, by a process wherein the deformation operation is carried out, isothermally, or quasi-isothermally, in a single step, at a temperature just below the solidus temperature of the alloy of the workpiece, at a comparatively low deformation rate, and at low specific deformation forces, the workpiece and the tool being kept, at least during the final, longer-lasting phase of the working operation, as precisely as possible at the same, maximum permissible temperature in the vicinity of the solidus line. The material is advantageously subjected to a preliminary homogenization heat-treatment at this maximum permissible temperature and cooling to room temperature, before the working process. Very good die-filling capacity.

14 Claims, 1 Drawing Figure

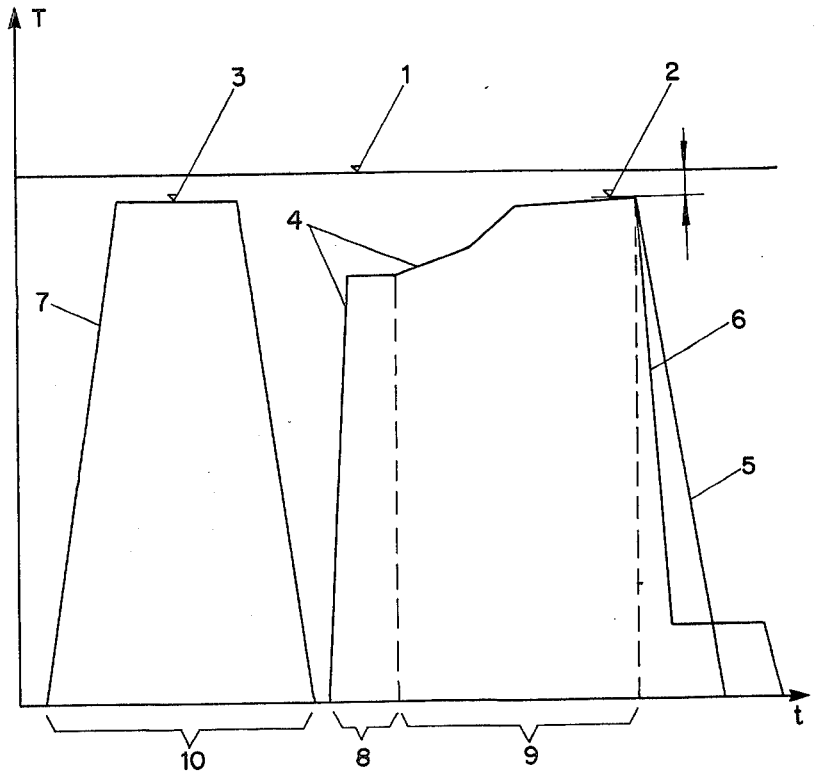
T
3
1
2
4
7
6
5
t
10
8
9

PROCESS FOR MANUFACTURING A SEMI-FINISHED PRODUCT OR A FINISHED COMPONENT FROM A METALLIC MATERIAL BY HOT WORKING

The starting point of the invention is a process for manufacturing a semi-finished product or a finished component by hot working a metallic material.

In the hot working of metallic materials, efforts are made, for economic reasons, on the one hand to keep the number of process steps as low as possible and, on the other hand to approach the final shape as closely as possible, in order to restrict the extent of any expensive cutting-type machining operation which may be required. Known processes of this type are, for example, isothermal or quasi-isothermal working (working with heated tools), in the manner which has gained wide acceptance, above all, in the case of forging (die-forging). Furthermore, attempts are made, by carrying out the working operation in the so-called "superplastic" state of the material—insofar as such a state can be brought about at all—to reduce the resistance to deformation while simultaneously improving the die-filling capability (see G. Schroöder, "Isothermes und superplastisches Umformen beim Gesenkschmieden [Isothermal and superplastic working in die-forging]", Werkstatt und Betrieb 113/1980/11, pages 765–770; G. H. Gessinger, "Isothermes Umformen—Ein kostengünstiges Präzisionsschmiedeverfahren [An economical precision-forging process]", Fachberichte Hüttenpraxis Metallweiterverarbeitung 11/78, pages 954–957).

In the working processes which have been described, the possibilities of an economic production process are only incompletely utilized. Conventional isothermal deformation is, as a rule, carried out at temperatures which are comparatively low, that is to say, at temperatures which are considerably displaced, for safety reasons, from the solidus temperature. However, at these temperatures the ductility of the workpiece to be deformed is not as high as would be desired, and the necessary deformation forces and deformation energy is (sic) comparatively high. On the other hand, in the case of superplastic working, there is the requirement that the blank should have an ultrafine grain size, which can be obtained only by means of certain alloying additions and elaborate thermo-mechanical processes. Certain materials exhibit no superplasticity in any case, so that these requirements with regard to the structure of the material again come into conflict with its relevant limitations. There is accordingly a major need, quite generally, to increase the scope of the possibilities offered by the hot working of metallic materials, and to extend them to as many materials as possible, through refining the processes and through widening their applicability.

The object underlying the invention is to indicate a hot-working process for metallic materials, which, while being very simple, enables semi-finished products or finished components to be manufactured in as few steps as possible and which, by virtue of a good die-filling capability, permits the design-related limits to be widened. The process should, if possible, be applicable to a large number of materials.

This object is achieved, according to the invention, by heating a workpiece, which initially exists as a cast billet, rolled billet, or a forged blank, to a temperature which lies 5 degrees Kelvin, up to a maximum of 0.15 $T_{sol}$, in degrees Kelvin, below the solidus temperature of the material. The workpiece is then brought into contact with a tool, the temperature of which is kept constant, and lower by 5 degrees Kelvin, up to 0.15 $T_{sol}$, in degrees Kelvin, to the solidus temperature of the material. The temperature of the same tool is also higher than the temperature to which the workpiece is preheated. Under these conditions, the workpiece is isothermally or quasi-isothermally, deformed at a deformation rate defined as $\dot{\phi}$ below.

$$\dot{\phi} = d\phi/dt = v/h$$

where v denotes the tool speed, h denotes the height of the workpiece, and $T_{sol}$ denotes the solidus temperature in degrees Kelvin.

This deformation rate, referred to in terms of the change in cross section, is of 0 to 10 $s^{-1}$. Whereby the temperature difference over the entire cross section of the workpiece, and considered over the total duration of the working operation, does not exceed 50° C.

The guiding concept of the invention resides in deforming the material at a temperature which, while below the solidus temperature, is as close to it as possible, while taking extreme care to avoid local melting. By this measure, the flow-stress (deformation resistance) of the material is quite considerably lowered, so that the optimum die-filling capability is achieved.

The invention is described by reference to the illustrative embodiments which follow, and to an explanatory FIGURE, which shows the sequence diagram of the process, in the form of a time/temperature function.

In the FIGURE, the abscissa represents the time-axis and the ordinate represents the temperature-axis. The solidus temperature $T_{sol}$ of the material (alloy) to be deformed is denoted by the horizontal line at the level 1, and this temperature must not, in any circumstances, be reached at any time throughout the entire process sequence. If this temperature were to be reached, local areas of incipient melting would result, and the cohesion and controlled microstructure of the material would disappear. 2 is the maximum temperature which may be reached, simultaneously by the workpiece and the tool—usually at the end of the working operation. This temperature must always remain, by a certain amount, below 1 ($T_{sol}$), depending on the alloy and the nature of the workpiece. 3 represents the temperature at which the workpiece is homogenized, the same applying to this temperature as in the case of temperature 2, in order to ensure, with safety, that areas of incipient melting do not subsequently occur during the working operation. 4 represents the variation of the workpiece temperature during the period up to the end of the working operation, which breaks down into the preheating phase 8 and the working phase 9. 5 represents the variation of the workpiece temperature in the course of normal cooling to room temperature. 6 is the analogous variation, following the working operation, for the case when this operation is directly followed by a further additional heat treatment (e.g. artificial ageing, high-temperature quenching, etc.). In most cases, it will be impossible to avoid subjecting the material to a preliminary homogenizing treatment. This, however, does not represent an absolutely necessary prerequisite for the process according to the invention, but signifies a preferred safety precaution. The temperature variation during the homogenization 10 is represented by the continuous line 7.

ILLUSTRATIVE EMBODIMENT I

Die-pressing of a centrifugal compressor impeller from an Al-Cu-Mg-Ni alloy

A centrifugal compressor impeller, 180 mm in diameter, was manufactured from a disk-shaped cylindrical blank, in one step, by isothermal high-temperature pressing. The aluminum alloy used conformed to the U.S.AA Standard 2618, and had the following composition:

Si=0.10–0.25% by wt.
Fe=0.9–1.3% by wt.
Cu=1.9–2.7% by wt.
Mg=1.3–1.8% by wt.
Ni=0.9–1.2% by wt.
Zn=0.10% by wt.
Ti=0.04–1.10% by wt.
Al=remainder A disk, in the form of a section cut from a bar, was utilized as the starting material. In its turn, the bar had been produced by the extrusion of a section of an extrusion-slug having a larger diameter, this slug having been produced by continuous casting. If the dimensions of the blank are comparatively large (disk of more than 200 mm diameter), it is also possible to employ, as preforms, work pieces which have been manufactured by open-die forging. The shape of the compressor impeller to be manufactured exhibited 18 blades, approximately 30 mm deep, located radially and slightly curved in the tangential direction, at the periphery, the wall thickness of these blades being approximately 4 mm at the root and approximately 2 mm at the tip. At the periphery, the disk-shaped impeller body had an axial wall thickness of approximately 6 mm.

Practical experiments have proved that it is completely impossible to manufacture a body having a complicated geometry of this kind by conventional pressing or forging. The shape actually obtained deviates considerably from the required values as a result of an inadequate die-filling capability.

Before the working operation, the starting material was subjected to a homogenization heat-treatment at a temperature of 520° C. for 20 hours. This measure serves to prevent the occurrence of local incipient melting or local pore formation while subsequently passing through the maximum temperature during the deformation operation, which was carried out, as an isothermal high-temperature die-pressing operation, on a hydraulic press, which was specially set up and equipped with a system, of the inductive type, for heating the workpiece and the tool.

The press was set up for low ram speeds, of 0.05–5 mm/s, which could be varied as desired during the pressing operation. In addition, the pressing force could, after reaching a preset limiting value, be held constant, even for a comparatively long predetermined period. The bed and the ram were provided with a cooling device. The induction-heating system comprised, in each case, an induction coil for heating the workpiece-blank and an induction coil for heating the tools (dies), which were manufactured from hot-work steel. Precise temperature-monitoring and temperature-control were ensured by means of thermocouples in the die and by means of probes at the workpiece-blank. A specially designed device served for transporting the workpiece into the heating zone and, as appropriate, into the region of the die as well as for ejecting it from the die on completion of the working operation, and for transporting it as far as the deposit point.

The workpiece-blank, in the form of a disk, was initially heated to a temperature of 480°±10° C. throughout, by pushing it into the appropriate induction coil. Immediately afterwards, the blank was placed in the die, which had been heated to 480°–520° C. The press speed was now set to an average value of approximately 0.5–1 mm/s. During this first phase of the upsetting process, during which the workpiece temperature adjusted itself to the temperature of the die, the pressing force rose only a little (from 0 to approx. 500 kN). The forming of the blades was now carried out in a second phase, the ram speed being reduced to 0.05–0.1 mm/s while, at the same time, the pressing force rose smoothly until it reached its maximum (approx. 3000 kN). The pressing force was now kept constant, in order to fill the die completely during this third phase, lasting approximately 5–10 minutes. The pressing time for a compressor impeller of this type was approximately 10–20 minutes, the average forming pressure amounting to approximately 120 MPa.

In the case of the Al-Cu-Mg-Ni alloy which was pressed here, the solidus temperature is 549° C., and the solution heat-treatment temperature is 530° C. In this alloy, the undissolved intermetallic compound $FeNiAl_9$ still exists at 520° C. as an independent phase. This phase prevents uncontrolled grain growth during the high-temperature working operation. The deformation temperature, of 480°–520° C., was selected as the optimum temperature in this regard, and there was likewise no need to fear the occurrence of local pore-formation resulting from areas of incipient melting.

In comparison with the die-pressing process according to the invention, the working process according to conventional forging technology, which is carried out, for the above mentioned aluminum alloy, in the temperature range from approximately 410°–450° C., is considerably less advantageous. In this conventional process, the forming pressures lie, according to experience, in the range from 200–500 MPa, and this requires heavier and more powerful presses. The die-filling capability is significantly poorer so that the blades fall far short of reaching the required dimension (rib wall-thickness 2–4 mm), and it is necessary to accept rib thicknesses of approximately 8–10 mm in the first step. This necessitates at least a few further steps, including an additional, expensive machining operation of the cutting type.

ILLUSTRATIVE EMBODIMENT II

Die-pressing a turbine blade from a precipitation-hardenable nickel-based superalloy A turbine blade, 150 mm long and 35 mm wide, was manufactured from a section cut from a bar, by isothermal high-temperature pressing, in one step. The alloy used, with the trade name Nimonic 80A, had the following composition:

Cr=19.5% by wt.
Co=1.0% by wt
Ti=2.25% by wt.
Al=1.4% by wt.
Fe=1.5% by wt.
C=0.05% by wt.
Cu=max. 0.10% by wt.
Ni=remainder A section from a rolled bar was utilized as the starting material. In order to make a homogeneous structure available for the working operation, the starting material was initially annealed under a protective atmosphere, at 1,080° C., for 8 hours, and was immediately afterwards quenched in water. The hydraulic press provided for carrying out the operation was, in principle, constructed similarly to the press described under Example I and possessed a ram speed adjustment-range from 0.05 to 25 mm/s. In addition, this press was enclosed in a manner enabling it to be operated with a protective atmosphere or under vacuum, according to choice. As tools, dies made of the known molybdenum alloy TZM were used, this alloy permitting operating temperatures of up to over 1,200° C. The induction-heating system was designed in the same manner as the system described under Example I. In addition to the transport system for the workpiece, lock-chambers were provided, which enabled the workpiece to be transferred between the press enclosure and the outside world.

The blank was initially heated, in the appropriate induction coil, to a temperature of 1,100°±20° C. and was immediately afterwards placed in the TZM die, which had been heated to 1,150°-1,200° C. The ram was thereafter pressed against the lower half of the die, at a press speed of approximately 4 mm/s (phase I). After the pressing force had begun to rise, deformation was continued with a press speed of approximately 0.1 mm/s, in order to fill the flash section (phase II). After reaching the maximum force, this value was kept constant, for approximately 5 minutes, until the die had been finally filled (phase III). Depending on the shape and the material, the duration of this phase can be approximately 1-10 minutes. The total pressing time for a turbine blade of this type can amount to approximately 2-15 minutes. In the present case, the average forming pressure reached the value of approximately 200 MPa.

The present nickel-based superalloy possesses a solidus temperature of approximately 1,360° C. and a solution heat-treatment temperature of approximately 1,080° C. In the temperature range from 1,150° to 1,200° C., which corresponds to an adequately large separation from the solidus line to guard against areas of incipient melting, undissolved metal carbides still exist in a finely dispersed form. These carbides prevent uncontrolled grain growth during the high-temperature deformation, as could also be determined by comparing micrographs of ground and polished sections.

In conventional forging and pressing, under hammers and screw presses operating at a higher speed, the forming pressures are, in comparison, considerably higher, and would reach values of 500-1,000 MPa in the present example. Apart from the required size of machines of this type, the limits to the creep strength of the material are also encountered at these higher forming pressures, leading to the risk that the die materials will develop surface cracks. The same disadvantages as have been stated under Example I exist with regard to the die-filling capability.

ILLUSTRATIVE EMBODIMENT III

High-temperature pressing of a turbine blade from a stainless ferritic steel, hardened by an oxide dispersion A turbine blade, 200 mm long and 50 mm wide, was manufactured from a section of bar, by isothermal high-temperature pressing, in one step. The ferrous alloy used had the following composition:

Cr=12.5% by wt.
Ti=3.5% by wt.
Mo=1.5% by wt.
C=0.02% by wt.
$Y_2O_3$=0.5% by wt.
$TiO_2$=1.0% by wt.
Fe=remainder A section of an extruded bar was used as starting material. The alloy per se was manufactured, in a known manner, by a powder-metallurgical technique involving mechanical alloying and subsequent compaction by extrusion. The blank was initially homogenized at a temperature of 1150° C., for 15 minutes and cooled again to room temperature. The further process steps were carried out in a manner analogous to that described under Example II. After the preheating step, the workpiece temperature was approximately 1150° C., while the temperature of the TZM tools (upper and lower portions of the die) was 1150°-1200° C. All the remaining parameters were adhered to in a manner similar to that in Example II (deformation-phases I-III).

The oxidic dispersoids $Y_2O_3$ and $TiO_2$, which are present in a sub-microscopic form and dispersion, are thermally stable up to over 1200° C., and reliably prevent uncontrolled grain-growth during the operations. A finished component, manufactured in this manner from a dispersion alloy, is distinguished, compared to a workpiece which has been produced directly, according to the customary method, by powder metallurgy (pressing+sintering, hot isostatic pressure), by maximum density, that is to say, by absolute freedom from pores.

ILLUSTRATIVE EMBODIMENT IV

High-temperature extrusion/hot impact-extrusion of semi-finished products and finished components from a Cu-Al-Ni memory alloy containing an oxidic dispersoid A circular-section rod, 5 mm in diameter, was manufactured from an extrusion slug having a diameter of 20 mm, by isothermal high-temperature extrusion. The alloy used, with a shape-memory capability, had the following composition:

Al=13% by wt.
Ni=3% by wt.
$Al_2O_3$=0.4% by wt.
Cu=remainder

A precompacted billet, serving as an extrusion slug, was used as the starting material, this billet having been manufactured by a powder-metallurgical technique involving mechanical alloying, from a Cu-Ni master alloy and aluminum containing $Al_2O_3$. The extrusion slug was initially homogenized at 950° C. for one hour, and cooled again to room temperature. It was then heated to a temperature of 850° C. and was extruded through a die, made of a nickel-based alloy (trade designation IN-100), at a temperature of 850°-950° C., to produce a strand having a diameter of 5 mm. Impermissible grain-growth during the extrusion operation is prevented by the presence of the $Al_2O_3$ dispersoid in superfine dispersion.

At these comparatively high temperatures, only just below the solidus line, both extrusion and hot impact-extrusion permit more complicated shapes to be produced, as well as transitions with smaller radii of curvature, by virtue of the improved die-filling capability. In this manner, it is even possible, in particular, to produce thin-walled ribs (e.g. on finned tubes), which is also of considerable importance, above all for heat exchangers (aluminum or copper alloys).

The invention is not restricted to the above illustrative embodiments. Both the workpiece and the tool should be brought, for the deformation process, to a temperature which lies between 5 degrees Kelvin and a maximum of 0.15 $T_{sol}$, in degrees Kelvin, below the solidus temperature of the material ($T_{sol}$=solidus temperature in degrees Kelvin). The temperature-difference within the cross-section of the workpiece, and over the total duration of the isothermal/quasi-isothermal working operation, should not exceed 50° C. and the deformation rate $\dot{\phi}$ should amount to 0 to 10 $s^{-1}$, where $$\dot{\phi}=v/h$$

wherein v denotes the tool speed, and h denotes the height of the workpiece.

The workpiece is advantageously homogenized before the hot-working operation, this homogenizing treatment being carried out for 0.1 to 100 hours, at a temperature corresponding to the highest deformation temperature which effectively occurs, in order to prevent the subsequent occurrence of local areas of incipient melting and pore formation, and after this treatment the workpiece is cooled to room temperature again. The cooling step after the hot-working operation can also be carried out by quenching to room temperature in water or in oil. In addition, the quenching treatment can be carried out in a manner similar to high-temperature quenching to a temperature above the room temperature, into a metal bath or a salt bath, with subsequent ageing. The hot-working operation can, in principle, comprise a die-forging operation, a hot-pressing operation, a hot impact-extruding operation, or a hot-extrusion operation. The hot working operation should advantageously be carried out in a temperature range in which, in addition to a first phase, which forms the major constituent of the structure, an additional, second phase, which inhibits the grain growth, is present during at least the total time over which deformation takes place. This phase which inhibits the grain-growth, can preferably be composed of an oxidic dispersoid, such as $Y_2O_3$, $TiO_2$, $Al_2O_3$ etc., or of a conventional oxide or of a carbide. In this manner, it is possible, for example, to work aluminum alloys, copper alloys (particularly Cu-Al-Ni), nickel-based superalloys, nickel-based dispersion alloys, as well as nickel alloys of the Ti-Ni type (normally alloys), or Ni-Ti-Cu alloys. Furthermore, the process can be applied to creep-resistant stainless ferritic steels, ferritic/austenitic steels and austenitic steels, in particular steels hardened by oxide dispersions. The material to be deformed can, moreover, be present, in the raw state as a porous sintered body, or as an unsintered body, which has been produced, from a sinter material, in a cold pre-pressing operation, this body being converted into the intended shape during the deformation operation, concurrently with being compacted and sintered.

We claim:

1. Process for manufacturing a semi-finished product or a finished component from a metallic material, by hot working, wherein a workpiece, which initially exists as a cast billet, a rolled billet, or a forged blank, is heated to a temperature which lies 5 degrees Kelvin, up to a maximum of 0.15 $T_{sol}$, in degrees Kelvin, below the solidus temperature of the material, the workpiece is thereupon brought into contact with a tool, the temperature of which is kept constant, and is lower, by 5 degrees Kelvin, up to 0.15 $T_{sol}$, in degrees Kelvin, than the solidus temperature of the material, but is higher than the temperature to which the workpiece is preheated, and the workpiece is quasi-isothermally deformed, at a deformation rate $\phi$, referred to the change in cross-section, of 0 to 10 $s^{-1}$, in such a manner that the temperature-difference over the entire cross-section of the workpiece, and considered over the total duration of the working operation, does not exceed 50° C., $\dot{\phi}$ being defined in the following manner:

$$\dot{\phi}=d\phi/dt=v/h$$

where v denotes the tool speed, h denotes the height of the workpiece, and $T_{sol}$ denotes the solidus temperature in degrees Kelvin, and the workpiece is finally subjected to a cooling step.

2. Process as claimed in claim 1, wherein the workpiece is homogenized before being heated for the hot-working operation, this homogenizing treatment being carried out for 0.1 to 100 hours, at a temperature corresponding to the highest deformation temperature which effectively occurs, in order to prevent the subsequent occurrence of areas of incipient melting and pore-formation, and after which treatment the workpiece is cooled to room temperature again.

3. Process as claimed in claim 1, wherein the cooling step to which the workpiece is subjected comprises a quenching treatment, from the deformation temperature, to room temperature, in water or oil, or to a temperature above room temperature, in oil, metal or a salt bath and the workpiece is thereafter aged at room temperature or at a temperature above room temperature.

4. Process as claimed in claim 1, wherein the hot-working operation comprises a die-forging operation, a hot-pressing operation, a hot impact-extruding operation, or a hot-extrusion operation.

5. Process as claimed in claim 1, wherein the hot working operation is carried out in a temperature range of the material, in which range, in addition to a first phase, which forms the major constituent of the structure, an additional, second phase, which inhibits the grain-growth, is present during at least the total time over which deformation takes place.

6. Process as claimed in claim 5, wherein the phase which inhibits the the grain-growth is composed of an oxide dispersoid, such as $Y_2O_3$, $TiO_2$, or of an oxide or a carbide.

7. Process as claimed in claim 1, wherein the material to be deformed is an aluminum alloy.

8. Process as claimed in claim 7, wherein the aluminum alloy possesses the following composition:

1.9–2.7% Cu 1.3–1.6% Mg 0.9–1.2% Ni

Remainder Al.

9. Process as claimed in claim 1, wherein the material to be deformed is a copper alloy, of the type Cu/Al/Ni.

10. Process as claimed in claim 1, wherein the material to be deformed is a nickel-based superalloy, or a nickel-based dispersion alloy or a nickel alloy of the type Ni/Ti or Ni/Ti/Cu.

11. Process as claimed in claim 1, wherein the material to be deformed is a creep-resistant, ferritic stainless steel, a ferritic/austenitic steel, or an austenitic steel.

12. Process as claimed in claim 11, wherein the material to be deformed is a ferritic steel which has been hardened by means of an oxide dispersion.

13. Process as claimed in claim 1, wherein the material to be deformed is a sinter material which exists, in the raw state, as a porous sintered body, or as an unsintered body, which has been produced in a cold pressing operation, this body being converted into the intended shape during the deformation operation, concurrently with being compacted and sintered.

14. The process of claim 1, wherein said workpiece is isothermally deformed.

* * * * *